US007337783B2

(12) United States Patent
Han

(10) Patent No.: US 7,337,783 B2
(45) **Date of Patent: *Mar. 4, 2008**

(54) FINGERNAIL ACCESSORY AND METHOD OF FORMING AN ARTIFICIAL FINGERNAIL

(75) Inventor: Kyu Sang Han, Port Washington, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 345 days.

This patent is subject to a terminal disclaimer.

(21) Appl. No.: 11/041,182

(22) Filed: Jan. 20, 2005

(65) Prior Publication Data

US 2005/0121048 A1 Jun. 9, 2005

Related U.S. Application Data

(63) Continuation-in-part of application No. 10/348,718, filed on Jan. 22, 2003, now Pat. No. 7,150,281, which is a continuation-in-part of application No. 10/281,500, filed on Oct. 28, 2002, now abandoned, application No. 11/041,182, which is a continuation-in-part of application No. 10/641,986, filed on Aug. 15, 2003, now abandoned, which is a continuation-in-part of application No. 10/348,718, and a continuation-in-part of application No. 10/281,500.

(51) Int. Cl.
*A45D 29/00* (2006.01)

(52) U.S. Cl. ..... 132/73

(58) Field of Classification Search ..... 132/73, 132/200, 73.5

See application file for complete search history.

(56) References Cited

U.S. PATENT DOCUMENTS

| | | | | |
|---|---|---|---|---|
| 1,135,382 | A | 4/1915 | Kindred | |
| 2,199,207 | A * | 4/1940 | Nolan | 132/73 |
| 2,234,657 | A | 3/1941 | Smaldone | |
| 2,239,040 | A | 4/1941 | Holmes | |
| 2,607,356 | A | 8/1952 | Lewis | |
| 3,502,088 | A | 3/1970 | Jarby | |
| 4,034,769 | A | 7/1977 | Nishimura | |
| 4,222,399 | A | 9/1980 | Ionescu | |
| 4,511,608 | A | 4/1985 | Ferraro | |
| 4,577,648 | A | 3/1986 | Dinerstein et al. | |
| 4,632,134 | A | 12/1986 | Reid | |
| 4,671,305 | A | 6/1987 | Mann | |
| 4,745,934 | A | 5/1988 | Mast et al. | |

(Continued)

FOREIGN PATENT DOCUMENTS

| | | |
|---|---|---|
| GB | 2 352 628 | 2/2001 |

(Continued)

*Primary Examiner*—Robyn Doan
(74) *Attorney, Agent, or Firm*—Collard & Roe, P.C.

(57) ABSTRACT

A fingernail accessory and method of forming an artificial fingernail is provided in which a layer of settable polymeric material is received on the accessory for forming the artificial fingernail on the wearer's natural fingernail. In one aspect, the accessory includes a polymeric body having an upper surface, a lower surface, a proximal end and a distal end. A base is secured to at least a portion of the lower surface. The base extends beyond the proximal end of the polymeric body and is adapted to receive a layer of settable polymeric material when the base is applied to a natural fingernail to form an artificial fingernail.

15 Claims, 1 Drawing Sheet

U.S. PATENT DOCUMENTS

| | | | | |
|---|---|---|---|---|
| 4,751,935 | A | 6/1988 | Mast et al. | |
| 4,767,648 | A | 8/1988 | Hokama et al. | |
| 4,824,702 | A | 4/1989 | Straub | |
| 4,860,774 | A | 8/1989 | Becker | |
| 4,876,121 | A | 10/1989 | Cohen | |
| 4,884,680 | A | 12/1989 | Israel et al. | |
| 4,920,991 | A | 5/1990 | Shibahashi et al. | |
| 4,943,462 | A | 7/1990 | Komerska et al. | |
| 5,044,384 | A | 9/1991 | Hokama et al. | |
| 5,150,726 | A | 9/1992 | Rucker | |
| 5,415,903 | A | 5/1995 | Hoffman et al. | |
| 5,638,835 | A | 6/1997 | Franz et al. | |
| 5,638,837 | A | 6/1997 | Juhl et al. | |
| 5,645,090 | A | 7/1997 | Juhl et al. | |
| 5,699,813 | A | 12/1997 | Carroll | |
| 5,782,248 | A | 7/1998 | Chang | |
| 5,860,429 | A | 1/1999 | Chang | |
| 5,901,714 | A | 5/1999 | Benkart | |
| 5,908,035 | A | 6/1999 | Carroll et al. | |
| 5,927,293 | A | 7/1999 | Halpern | |
| 5,944,027 | A | 8/1999 | Chang | |
| 5,964,977 | A | 10/1999 | Sirdesai et al. | |
| 6,042,679 | A | 3/2000 | Holt et al. | |
| 6,196,234 | B1 | 3/2001 | Gifford | |
| 6,303,140 | B1 | 10/2001 | Dever et al. | |
| 6,328,039 | B1 | 12/2001 | Chang | |
| 6,354,304 | B1 * | 3/2002 | Chang | 132/200 |
| 6,382,217 | B2 | 5/2002 | Coker et al. | |
| 6,394,100 | B1 | 5/2002 | Chang | |
| 6,631,723 | B1 * | 10/2003 | Mullin | 132/73 |
| 7,150,281 | B2 * | 12/2006 | Han | 132/73 |
| 2005/0022834 | A1 | 2/2005 | Hwang | |
| 2007/0051384 | A1 | 3/2007 | Fracassi et al. | |

FOREIGN PATENT DOCUMENTS

| | | |
|---|---|---|
| JP | 5-56007 | 7/1993 |
| KR | 0130038 | 11/1997 |

* cited by examiner

FINGERNAIL ACCESSORY AND METHOD OF FORMING AN ARTIFICIAL FINGERNAIL

CROSS-REFERENCE TO RELATED APPLICATIONS

This application is a continuation-in-part of U.S. Ser. No. 10/348,718 filed Jan. 22, 2003 now U.S. Pat. No. 7,150,281, which is a continuation-in-part of U.S. Ser. No. 10/281,500 filed Oct. 28, 2002 now abandoned. This application is also a continuation-in-part of U.S. Ser. No. 10/641,986 filed Aug. 15, 2003 now abandoned which is also a continuation-in-part of U.S. Ser. No. 10/348,718 now U.S. Pat. No. 7,150,281 and U.S. Ser. No. 10/281,500 now abandoned.

BACKGROUND OF THE INVENTION

1. Field of the Invention

The present invention relates to French manicures for fingernails. More particularly, the invention relates to a fingernail accessory for readily forming a "French tip" artificial fingernail on a user's natural fingernail and a method of forming a "ready for French tip" artificial fingernail.

2. The Prior Art

It is known in the art of adorning the hands to provide ornamental fingernail accessories made from thin, molded plastic members manufactured generally in the shape of a fingernail. See, e.g. Chang U.S. Pat. No. 6,394,100 and U.S. Pat. No. 4,751,935 to Mast et al. It is also known to apply nail polish to human nails in a style known as a French manicure or French tip using fingernail masks or guides to assist in applying the nail polish. See, e.g., U.S. Pat. No. 2,234,657 to Smaldone; U.S. Pat. No. 2,239,040 to Holmes; U.S. Pat. No. 4,577,648 to Dinerstein et al; U.S. Pat. No. 5,044,384 to Hokama et al; U.S. Pat. No. 5,150,726 to Rucker; U.S. Pat. No. 5,638,837 and 5,645,090 to Juhl et al; U.S. Pat. No. 5,782,248 to Chang; and U.S. Pat. No. 5,901,714 to Benkart.

As discussed, for example, in U.S. Pat. No. 5,645,090 to Juhl et al, a French manicure generally involves applying a white or off-white polish in a uniform line at the tip of the nail while not applying such polish to remainder of the nail, i.e. that portion extending from the tip of the nail to the cuticle of the nail. Several methods of obtaining a French manicure are discussed in the patent, including employing a highly skilled manicurist, which is difficult, time consuming and expensive. It is also known to provide a composite artificial fingernails having a "French manicure" look. See U.S. Pat. No. 5,908,035 to Carroll et al.

Although a number of methods of obtaining a French manicure are known, there is still a need for a fingernail accessory and a method for forming an artificial fingernail that permits a user to simply and inexpensively obtain the appearance of a French manicure.

SUMMARY OF THE INVENTION

A fingernail accessory and a method of forming an artificial fingernail are provided. In one aspect, the fingernail accessory is adapted to receive a layer of settable polymeric material for forming an artificial fingernail and includes a polymeric body and a base. The polymeric body has an upper surface, a lower surface, a proximal end and a distal end. The base is secured to at least a portion of the lower surface. The base extends beyond the proximal end of the polymeric body and is adapted to receive a layer of settable polymeric material when the base is applied to a natural fingernail. The settable polymeric material applied to the base combines with the polymeric body to form an artificial fingernail.

In another aspect, a method of forming an artificial fingernail on a natural fingernail is provided. In accordance with the method, a fingernail accessory is provided including a polymeric body and a base. The polymeric body has an upper surface, a lower surface, a proximal end, and a distal end. The base is secured to at least a portion of the lower surface and extends beyond the proximal end of the polymeric body. The base is adhered with an adhesive to at least a portion of the natural fingernail, and a settable polymeric material is applied to the base to form an artificial fingernail.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawing, wherein similar reference characters denote similar elements throughout the several views.

DETAILED DESCRIPTION OF PREFERRED EMBODIMENTS

Figure 1A:
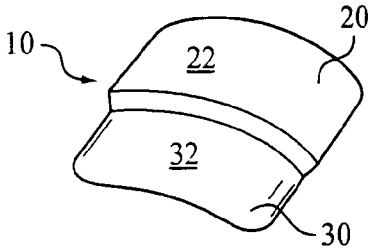
FIGS. 1A and 1B are perspective and side views, respectively, of an embodiment of a fingernail accessory of the present invention.
Figure 1B:
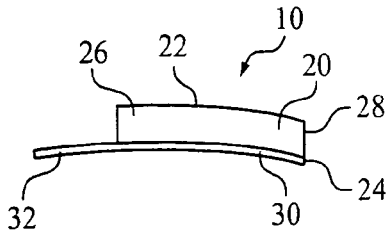

Turning now in detail to the drawings, FIGS. 1A and 1B show a fingernail accessory of a preferred embodiment which is adapted to receive a layer of settable polymeric material for forming an artificial fingernail. The term "artificial fingernail" is meant to include both a full-cover nail intended to be worn over the entire surface of a wearer's natural fingernail and a fingernail extension intended to be worn over a portion of a wearer's natural fingernail.

Fingernail accessory 10 includes a polymeric body 20 and a base 30. Polymeric body 20 may have the general overall shape and configuration of at least an end portion of a natural fingernail. Body 20 has an upper surface 22, a lower surface 24, a proximal end 26, and a distal end 28. Polymeric body 20 is preferably made from a mixture of acrylonitrile-butadiene-styrene (ABS) plastic and a polycarbonate, but may be made from any plastic-like material commonly employed in the manufacture of artificial nails, such as ABS plastic, nylon, tenite acetate, vinyl acetate, polycarbonates, polyvinyl chloride, etc., using conventional injection molding techniques known in the art.

Examples of suitable hard materials for polymeric body 20 are Styrolux® 684D (SBC), a styrene-butadine block copolymer available from BASF Corporation; Cyro® R40 (acrylic base), an acrylic-based multipolymer available from Cyro Industries of Rockaway, N. J.; Lexane KR01(PC) (trade name), a polycarbonate available from GE Plastics; K-resin®(SBC), a styrene-butadiene copolymer available from Chevron Phillips Chemical Company; TP-UXS (MMBS) (trade name), a methyl methacrylate butadiene styrene terpolymer available from DENKA of Tokyo, Japan;

Starex® 5010 (ABS), an acrylonitrile butadiene styrene available from Samsung Cheil Industries; Zylar® 220 (SMMC) and Nas® 30, styrene methyl methacrylate copolymers available from Nova Chemicals; and Toyalac 920 (clear ABS), an acrylonitrile butadiene styrene available from Toray Resin Company.

Figure 2:
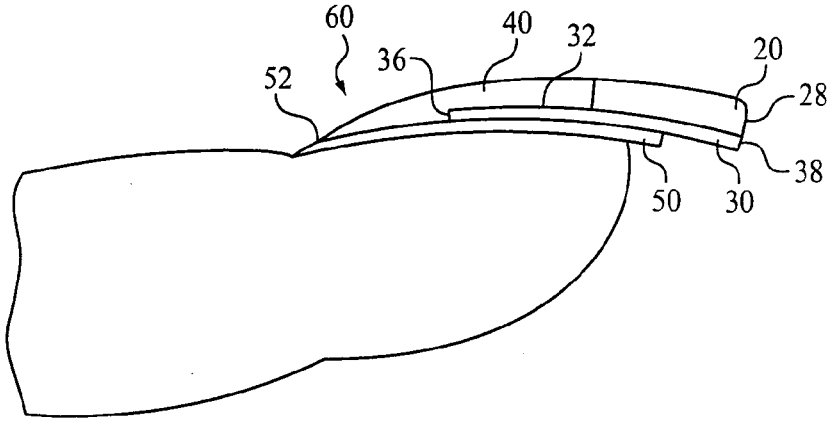
FIG. 2 is a side view of an artificial fingernail formed using the embodiment of FIGS. 1A and 1B.

Base 30 is secured to at least a portion of lower surface 24 of polymeric body 20. Base 30 preferably has a curvature such that its underside concave surface in a side to side direction generally matches the upper convex surface of the natural nail to allow a reasonably matching fit there-between. As shown in FIGS. 1A, 1B and 2, base 30 extends beyond proximal end 26 of polymeric body to form an area 32 bounded in part by proximal end 26 which forms a step with base 30. Area 32 is adapted to receive a layer of settable polymeric material 40 when base 30 is applied to a natural fingernail 50 to form an artificial fingernail 60 shown in FIG. 2. Artificial fingernail 60 is formed from the combination of fingernail accessory 10 and the hardened polymeric material 40, such as a solidified liquid polymeric material, applied to base area 32 and optionally also to the wearer's natural fingernail 50 in the area between the proximal end 36 of base 30 and the cuticle area 52 of the wearer's finger. Proximal end 36 of base 30 may also extend to cuticle area 52 of the wearer's finger. In such case, proximal end 36 preferably has a curved "half moon" perimeter to fit within the area of the natural fingernail adjacent to the cuticle area. As shown in FIG. 2, the distal end 38 of base 30 is preferably aligned with distal end 28 of polymer body 20 and together with distal end 28 extends from the wearer's natural fingernail 50 when worn.

Polymeric body 20 and base 30 may be transparent, translucent or opaque, but preferably polymeric body 20 has a white or near-white appearance and base 30 is clear or a translucent material simulating the natural color of a natural fingernail. The term "translucent" is meant to include both transparent or clear materials and tinted materials that permit materials disposed underneath to be visible therethrough. Although polymeric body 20 and base 30 may be made from the same polymeric material, polymeric body 20 is preferably made of a first opaque polymeric material and base 30 is made from a second translucent polymeric material which may be clear or tinted. Polymeric material 40 is preferably made from a clear or tinted pink acrylic material so that in combination with a white or near-white color of polymeric body 20, the appearance of a natural nail done in the French manicure style is simulated.

Polymeric body 20 and base 30 are generally of uniform thickness, for example 0.35 to 0.65 mm for body 20 and 0.100 to 0.150 mm for base 30, but may decrease in thickness (i.e. taper) at the distal ends 28,38 of body 20 and base 30. Base 30 preferably has a base thickness no greater than forty-five percent of the thickness of polymer body thickness.

Preferably, base 30 is made from a layer of deformable material adapted to conform to an upper surface of a natural fingernail when applied to the natural fingernail. By using a soft deformable material which may be clear or tinted, pinching is avoided at the cuticle area for a more comfortable fit. The layer of deformable material may decrease in thickness (i.e. taper) at the proximal end of base 30 to facilitate attachment and blending with the natural fingernail and to conform to the contour of the cuticle area.

The deformable material may be a thermoplastic elastomer (TPE) or thermoplastic polyurethane (TPU) or mixture thereof and is preferably silicone, a silicone derivative, rubber or other material which will deform under pressure to conform to the contour of the wearer's natural fingernail. For example, material suitable for forming soft contact lenses such as silicone elastomers, silicone-containing macromers, hydrogels, silicone-containing hydrogels, siloxanes, siloxane macromers, and mixtures thereof may be used. The deformable material forming base 30 may be applied under polymeric body 20 by spray molding, double injection, manual application or any other suitable application.

Examples of suitable soft or deformable materials are Versaflex® OM 9-802CL, a thermoplastic elastomer alloy available from GLS Corporation of Arlington Heights, Ill.; TPE 40ANS200 (trade name), a thermoplastic elastomer alloy available from Advanced Elastomer Systems; Elastollan® TPU, a thermoplastic polyurethane elastomer available from BASF Corporation; Estane TPU (trade name), a thermoplastic polyurethane elastomer available from Noveon, Inc; and Engage 8407 TPU, a polyolefin elastomer available from Du Pont Dow Elastomers of Wilmington, Del.

Figure 3A:
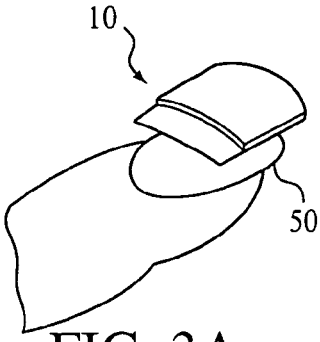
FIGS. 3A and 3B are perspective views of the embodiment of FIGS. 1A and 1B illustrating steps in the method according to the invention.
Figure 3B:
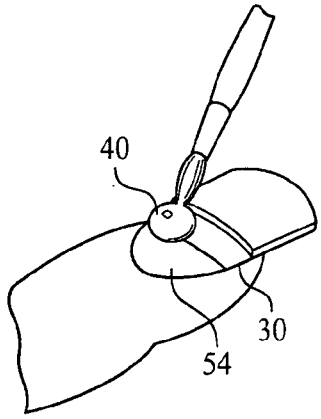

FIGS. 3A and 3B illustrate steps in a method of forming an artificial fingernail on a natural fingernail. As shown in FIG. 3A, a fingernail accessory 10 is provided and applied to at least a portion of a natural fingernail 50 with a selected conventional adhesive, such as an ethyl cyanoacrylate-based glue or other commercially available nail glue commonly used to adhere artificial fingernails to a wearer's fingernail. The adhesive may be applied to the upper surface of the natural fingernail or to the underside of base 30 or to both.

As shown in FIG. 3B, preferably after drying of the adhesive, settable polymeric material 40 such as a clear or tinted acrylic-based polymer is applied to base 30 of fingernail accessory 10 to form an artificial fingernail such as is shown in FIG. 2.

Preferably, base 20 is adhered to natural fingernail 50 so as to leave a proximal area 54 of the natural fingernail uncovered by base 20. The settable polymeric material 40 is then applied so as to cover base 20 and proximal area 54. The settable polymeric material 40 may also be applied to cover at least a portion of upper surface 22 of polymeric body 20.

Settable polymeric material 40 may be any polymeric material that may be applied with a brush and that hardens into a plastic material. Acrylic based polymers are preferred, such as an acrylonitrite-butadiene-styrene (ABS) plastic or a copolymer of acrylic ester and vinyl acetate formed from an aqueous acrylic copolymer emulsion. Preferably, polymeric body 20 is made of a first opaque polymeric material, base 30 is made of a second translucent polymeric material, and settable polymeric material 40 is a liquid material that dries to form a translucent layer of polymeric material that may be tinted pink in color.

An example of a suitable settable polymeric material is an acrylic powder, such as a methacrylate copolymer, combined with an acrylic liquid, such as an ethyl methacrylate monomer. Preferably, an activator, such as an acetone/ethyl acetate solution, is used with the acrylic powder and acrylic liquid to cause the material to set. The activator may be applied, for example, with a pump spray bottle.

Alternatively, a typical nail glue such as a gel glue which may be tinted pink may be used as the settable polymeric material.

Also suitable is a liquid ethyl 2-cyanoacrylate adhesive material which rapidly polymerizes upon contact with water or alkaline substances. In addition, an acrylic gel that is activatable by ultraviolet light, such as #1768-V4-U.V. All Purpose Gel (trade name) available from AMCO International of W. Conshohocken, Pa. is suitable. Such UV gels may contain, for example, urethane acrylate, urethane dimethacrylate, glyceral propoxy triacrylate, triethylene glycol divinyl ether, triethylene glycol dimethacrylate esters, and 2-hydroxy-2-methyl-1-phenyl-1-propanone.

As is evident from the foregoing with the fingernail accessory according to the invention, a "ready for French tip" accessory may be provided in which the user may simply and easily obtain a French manicure by first applying the accessory (having a white tip) to the natural fingernail with nail glue and then applying acrylic material (clear or tinted pink) on the nail bed of the natural fingernail and the top of the white tip. When the acrylic hardens, an artificial fingernail in the French manicure style is obtained.

Although only at least one embodiment of the present invention has been shown and described, it is to be understood that many changes and modifications may be made there unto without departing from the spirit and scope of the invention as described in the appended claims.

What is claimed is:

1. A fingernail accessory adapted to receive a layer of settable polymeric material for forming an artificial fingernail comprising:

(a) a polymeric body having an upper surface, a lower surface, a proximal end and a distal end; and (b) a base having a base distal portion secured to and covered by at least a portion of said lower surface and a base proximal portion extending beyond said proximal end, said base receiving a layer of settable polymeric material when applied to a natural fingernail to form an artificial fingernail and having a base distal end aligned with said distal end of said polymeric body;

wherein the base is adhered to the natural fingernail so as to leave a proximal area of the natural fingernail uncovered by the base and the settable polymeric material is applied so as to cover the base proximal portion and the proximal area of the natural fingernail.

2. The fingernail accessory according to claim 1 wherein said polymeric body is made of a first opaque polymeric material and said base is made of a second translucent polymeric material.

3. The fingernail accessory according to claim 2 wherein said first opaque polymeric material is white in color and said second translucent polymeric material is transparent.

4. The fingernail accessory according to claim 1 wherein said base is made of a tinted translucent polymeric material.

5. The fingernail accessory according to claim 1 wherein said base has a base thickness and said polymeric body has a polymeric body thickness, said base thickness being no greater than 45% of said polymeric body thickness.

6. The fingernail accessory according to claim 1 wherein said polymeric body has a polymeric body thickness in a range of 0.35 to 0.65 mm and said base has a base thickness in a range of 0.100 to 0.150 mm.

7. The fingernail accessory according to claim 1 wherein said base comprises a layer of deformable material adapted to conform to an upper surface of a natural fingernail when applied to the natural fingernail.

8. A method of forming an artificial fingernail on a natural fingernail comprising the steps of:

(a) providing a fingernail accessory comprising a polymeric body and a base, the polymeric body having an upper surface, a lower surface, a proximal end, and a distal end, the base being secured to at least a portion of the lower surface and extending beyond the proximal end;

(b) adhering the base with an adhesive to at least a portion of the natural fingernail so as to leave a proximal area of the natural fingernail uncovered by the base; and (c) applying a settable polymeric material to the base so as to cover the base and the proximal area of the natural fingernail to form an artificial fingernail.

9. The method of forming an artificial fingernail according to claim 8 wherein the settable polymeric material is selected from the group consisting of a polymeric liquid and a polymeric gel.

10. The method of forming an artificial fingernail according to claim 8, wherein the settable polymeric material is applied to cover the base, the proximal area of the natural fingernail, and at least a portion of the upper surface of the polymeric body.

11. The method of forming an artificial fingernail according to claim 8 wherein the settable polymeric material comprises an acrylic-based polymer.

12. The method of forming an artificial fingernail according to claim 11 wherein the acrylic-based polymer comprises acrylonitrile-butadiene-styrene (ABS) plastic.

13. The method of forming an artificial fingernail according to claim 11 wherein the settable polymeric material comprises a copolymer of acrylic ester and vinyl acetate formed from an aqueous acrylic copolymer emulsion.

14. The method of forming an artificial fingernail according to claim 8 wherein the polymeric body is made of a first opaque polymeric material; the base is made of a second translucent polymeric material, and the settable polymeric material comprises a liquid material that dries to form a translucent layer of polymeric material.

15. The method of forming an artificial fingernail according to claim 14 wherein the settable polymeric material comprises a liquid material that dries to form a layer of polymeric material tinted pink in color.

* * * * *